US006252557B1

(12) United States Patent
Plugge et al.

(10) Patent No.: US 6,252,557 B1
(45) Date of Patent: Jun. 26, 2001

(54) PHOTONICS SENSOR ARRAY FOR WIDEBAND RECEPTION AND PROCESSING OF ELECTROMAGNETIC SIGNALS

(75) Inventors: Richard J. Plugge, Los Altos; William W. Anderson, Half Moon Bay, both of CA (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 09/409,388

(22) Filed: Sep. 30, 1999

(51) Int. Cl.[7] ..... H01Q 13/00
(52) U.S. Cl. ..... 343/772; 359/237; 385/2
(58) Field of Search ..... 343/824, 772, 343/751; 385/2, 8, 3, 5, 9, 12, 14, 40, 123, 129; 359/245, 254, 259, 237

(56) References Cited

U.S. PATENT DOCUMENTS

| | | | | |
|---|---|---|---|---|
| 3,944,330 | | 3/1976 | Tsunoda et al. . | |
| 5,278,924 | * | 1/1994 | Schaffner | 385/3 |
| 5,285,308 | | 2/1994 | Jenkins et al. . | |
| 5,347,601 | | 9/1994 | Ade et al. . | |
| 5,359,449 | | 10/1994 | Nishimoto et al. . | |
| 5,363,230 | | 11/1994 | Djupsjobacka . | |
| 5,488,677 | * | 1/1996 | Tokano | 385/3 |
| 5,543,805 | * | 8/1996 | Thaniyavarn | 342/368 |
| 5,568,574 | | 10/1996 | Tanguay, Jr. et al. . | |
| 5,613,020 | | 3/1997 | Uchida et al. . | |
| 5,615,037 | | 3/1997 | Betts et al. . | |
| 5,638,468 | * | 6/1997 | Tokano et al. | 385/3 |
| 5,799,116 | * | 8/1998 | Yamamoto | 385/2 |
| 5,862,276 | * | 1/1999 | Karras | 385/30 |
| 5,866,807 | * | 3/1999 | Cummings | 359/263 |

OTHER PUBLICATIONS

Choi et al. "Measurement of low frequency electric field using Ti:$LiNbO_3$ " IEE, 1993 pp. 7–10.
Young Electro–Optic E–Field Sensors for Shielding Measurements up to 18GHz; IEEE, pp. 87–91, 1995.
Harvey et al. "Optical up–conversion for passive millimetre–wave imaging", SPIE, vol. 3064; 1997.

* cited by examiner

*Primary Examiner*—Hoanganh Le
*Assistant Examiner*—Ephren Alemu
(74) *Attorney, Agent, or Firm*—Swidler Berlin Shereff Friedman, LLP

(57) ABSTRACT

A photonics sensor and array for the reception and processing of RF signals. In one embodiment, the present invention is an antenna comprising: a first electro-optically active optical waveguide; a first planar electrode substantially parallel to the first waveguide; a second electro-optically active optical waveguide; a second planar electrode substantially parallel to the second waveguide, the first and second planar electrodes being substantially adjacent and coplanar; and a third planar electrode substantially parallel to the first and second planar electrodes and disposed such that the first waveguide lies between the first and third planar electrodes, and the second waveguide lies between the second and third planar electrodes. In another embodiment, the present invention is an antenna comprising: first and second planar electrodes being substantially adjacent and coplanar; a first electro-optically active optical waveguide disposed between the planar electrodes; and a second electro-optically active optical waveguide substantially parallel to the first waveguide.

44 Claims, 8 Drawing Sheets

PHOTONICS SENSOR ARRAY FOR WIDEBAND RECEPTION AND PROCESSING OF ELECTROMAGNETIC SIGNALS

BACKGROUND OF THE INVENTION

1. Field of the Invention

The present invention relates generally to photonic sensors, and more particularly to electro-optic antennas and sensors for wideband reception and processing of electromagnetic signals.

2. Related Art

Array antennas for reception and transmission of electromagnetic signals are well known in the art. One important objective in the refinement of this type of antenna is to increase the operational bandwidth of the antenna.

Traditional arrays use conventional antenna elements. One disadvantage of this type of element is that it is usually limited to a small operational bandwidth. Further, these elements require some sort of transmission line, such as coaxial cable, microstrip, or stripline, to connect to each antenna element and a feed network. For antenna arrays having many elements, this approach results in structures that are quite heavy and large. Another disadvantage that results from this approach is an increase in backplane complexity. A further disadvantage is the substantial signal losses that are incurred on the transmission lines, as the desired frequency of operation is increased.

One conventional approach to increasing bandwidth is to use a "spiral" antenna element within the array. One disadvantage of this approach is that such spiral elements become large as the frequency of operation is reduced. Further, the spacing of these elements increases, resulting in a physically large structure. Further, this large spacing has adverse effects on the operation of the array. A further disadvantage is the backplane complexity mentioned above.

Another conventional approach is to use electrically small antennas to get around the spacing issue. However, the efficiency of this class of antennas is usually very poor.

SUMMARY OF THE INVENTION

The present invention is a photonics sensor and array for the reception and processing of RF signals. In one embodiment, the present invention is an antenna comprising: a first electro-optically active optical waveguide; a first planar electrode substantially parallel to the first waveguide; a second electro-optically active optical waveguide; a second planar electrode substantially parallel to the second waveguide, the first and second planar electrodes being substantially adjacent and coplanar; and a third planar electrode substantially parallel to the first and second planar electrodes and disposed such that the first waveguide lies between the first and third planar electrodes, and the second waveguide lies between the second and third planar electrodes.

In another embodiment, the present invention is an antenna comprising: first and second planar electrodes being substantially adjacent and coplanar; a first electro-optically active optical waveguide disposed between the planar electrodes; and a second electro-optically active optical waveguide substantially parallel to the first waveguide.

In another embodiment, the present invention is an antenna comprising: a plurality of cells, each cell comprising: a first electro-optically active optical waveguide; a first planar electrode substantially parallel to the first waveguide; a second electro-optically active optical waveguide; a second planar electrode substantially parallel to the second waveguide, the first and second planar electrodes being substantially adjacent and coplanar; and a third planar electrode substantially parallel to the first and second planar electrodes and disposed such that the first waveguide lies between the first and third planar electrodes, and the second waveguide lies between the second and third planar electrodes.

In another embodiment, the present invention is an antenna comprising: a plurality of cells, each cell comprising: first and second planar electrodes being substantially adjacent and coplanar; a first electro-optically active optical waveguide disposed between the planar electrodes; and a second electro-optically active optical waveguide substantially parallel to the first waveguide.

An optical source may be coupled to a first end of each of the waveguides. An output optical waveguide may be coupled to the second end of each of the first and second waveguides. A photodetector may be coupled to the output waveguide. A coupler may electrically connect the first and third planar electrodes, whereby the first and third planar electrodes may be kept at substantially the same electrical potential. The present invention may further comprise a polymer layer in which the waveguides are formed and to which the planar electrodes are attached. The first planar electrode may be arranged so that an incident electromagnetic signal will impinge upon the first planar electrode.

The third planar electrode may comprise a first portion and a second portion and may be disposed such that the first waveguide lies between the first planar electrode and the first portion of the third planar electrode, and the second waveguide lies between the second planar electrode and the second portion of the third planar electrode.

Further features and advantages of the present invention as well as the structure and operation of various embodiments of the present invention are described in detail below with reference to the accompanying drawings.

BRIEF DESCRIPTION OF THE FIGURES

The present invention will be described with reference to the accompanying drawings.

DETAILED DESCRIPTION OF THE PREFERRED EMBODIMENTS

The present invention is described in terms of the above example. This is for convenience only and is not intended to limit the application of the present invention. In fact, after reading the following description, it will be apparent to one skilled in the relevant art how to implement the present invention in alternative embodiments.

The present invention is a photonics sensor and array for the reception and processing of electromagnetic signals. It is especially useful for the reception of broadband signals and processing of that signal to extract information contained in the signal such as in active imaging, or as in synthetic aperture radar applications. It is also useful in bistatic and passive imaging.

Figure 1:
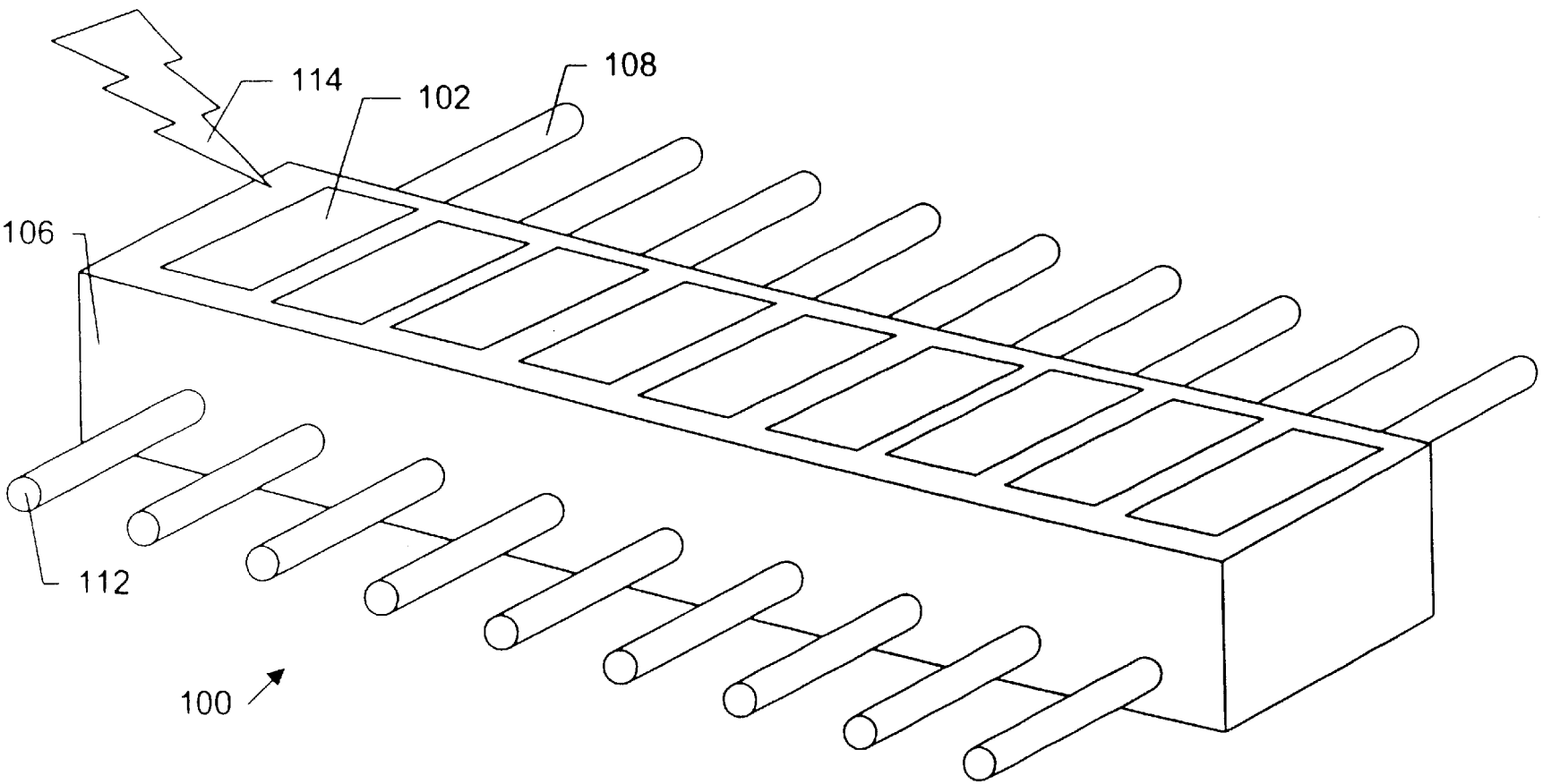
FIG. 1 depicts a sampler array according to a preferred embodiment of the present invention.

FIG. 1 depicts a sampler array 100 according to a preferred embodiment of the present invention. Sampler array 100 includes a plurality of antenna elements 102, a dielectric support 106, and optical fibers 108, 112. In a preferred embodiment, antenna elements 102 (also referred to as "radiators" ) are metallic strips (also referred to as "planar electrodes") printed upon a polymer sheet, although other materials or antenna elements may be used. Sampler array 100 also includes a plurality of Mach-Zehnder modulators (not shown); each centered underneath the gap between a pair of adjacent antenna elements 102. A metallic coupling strip (not shown) resides below each Mach-Zehnder modulator, extending underneath each arm of the Mach-Zehnder modulator, and together with a pair of antenna elements 102 forms a pair of capacitors, where each arm of the modulator lies within one of the capacitors. The sampler array 100 may can include more or less elements than depicted in FIG. 1 and may be configured to form a 2-dimensional or planar array.

Each Mach-Zehnder modulator is stimulated by an optical source via an input fiber 108. In a preferred embodiment, the optical source is a laser. An electromagnetic wavefront 114, impinging on the sampler array 100, will generate a field across the sampler array 100 which will in turn set up a voltage across each gap between adjacent antenna elements 102 and between each antenna element 102 and a corresponding coupling strip. This voltage modulates the optical drive signal provided by input fibers 108. Output fibers 112 are fed to a photodiode or the like, where the signal may be recovered according to conventional methods. This condition is repeated across the entire structure 100 and effectively samples the electromagnetic wavefront 114, which can then be reconstructed. By keeping the antenna elements 102 small, the response bandwidth of the sampler array 100 can be made very large.

In a preferred embodiment, one antenna element 102 in each pair of antenna elements is held to the same voltage potential as the corresponding coupling strip. In addition, a DC bias can be applied to the other antenna element in the pair to bias the Mach-Zehnder modulator at its quadrature point or any other point that is desired.

Figure 2:
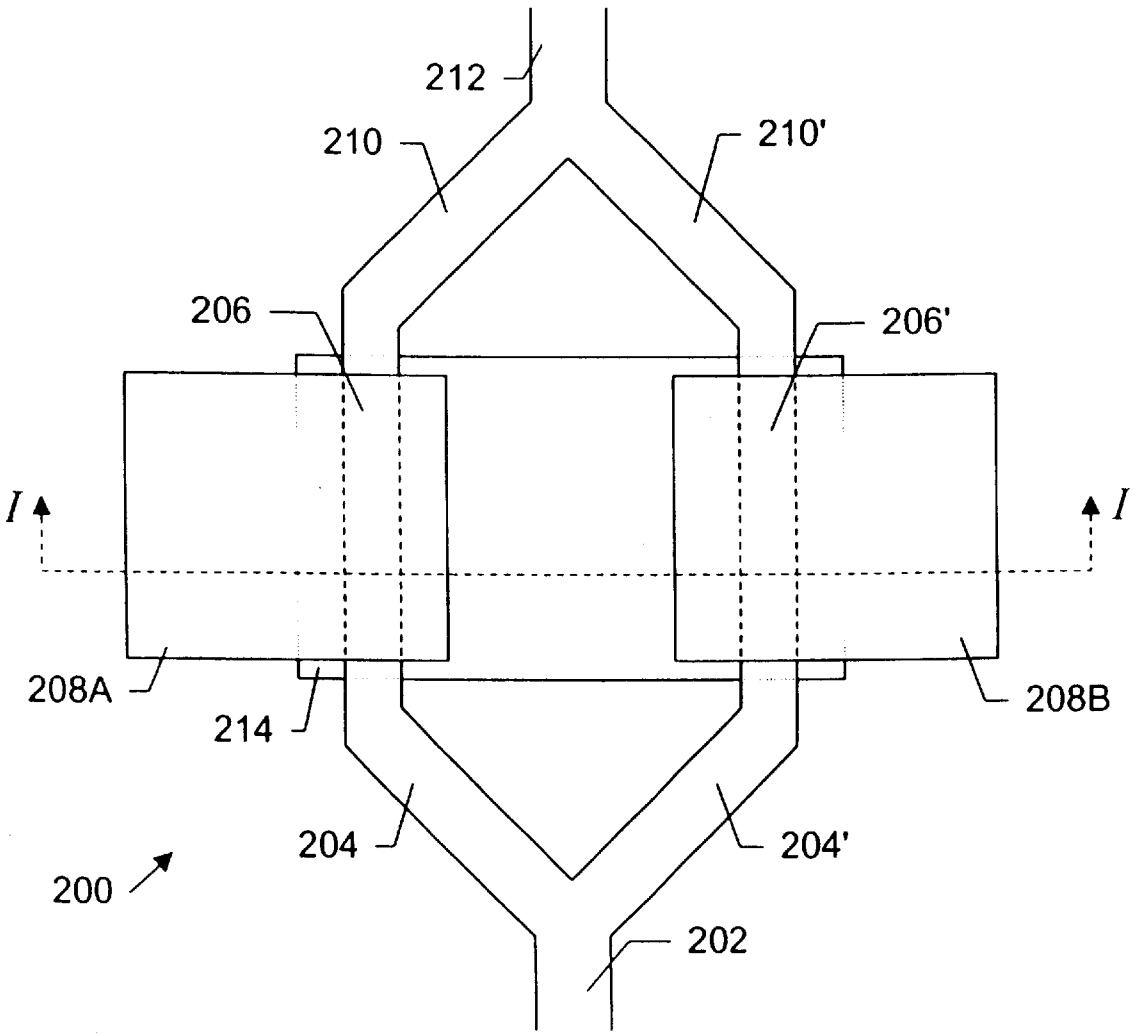
FIG. 2 is a frontal view of a portion of a sampler array corresponding to a single sampler "cell" according to one embodiment of the present invention.

FIG. 2 is a frontal view of a portion of sampler array 100 corresponding to a single sampler "cell" 200 according to one embodiment of the present invention. The sampler cell includes two antenna elements 208A and 208B, a coupling strip 214, and a pair of optical waveguides 206 and 206', which form the "arms" of a Mach-Zehnder modulator. Each arm 206 lies between one of the antenna elements 208 and coupling strip 214, which effectively forms a pair of capacitors, where each arm 206 of the modulator lies between the plates of one of the capacitors. Other coupling configurations or schemes are contemplated. In a preferred embodiment, one antenna element 208 is tied electrically to coupling strip 214 to bring them to the same electrical potential, while the other antenna element has a DC bias applied to it, to bias the modulator at a desired operating point. The Mach-Zehnder modulator includes an optical input channel 202, which receives the optical drive signal provided by an input fiber 108. The optical input signal is split into two optical paths 204 and 204'. The optical signals pass beneath antenna elements 208A and 208B in optical channels 206 and 206'. Referring to FIG. 2, assume that antenna element 208B is electrically tied to coupling strip 214. The RF field that impinges on antenna elements 208 will then induce a varying voltage potential between the "floating" antenna element 208A and coupling strip 214. That voltage will advance or retard the optical signal in intervening optical path 206, changing its phase relative to "tied" optical path 206'. The optical signals exit the modulator on paths 210 and 210', and are combined, producing a modulated output optical signal 212.

Figure 3:
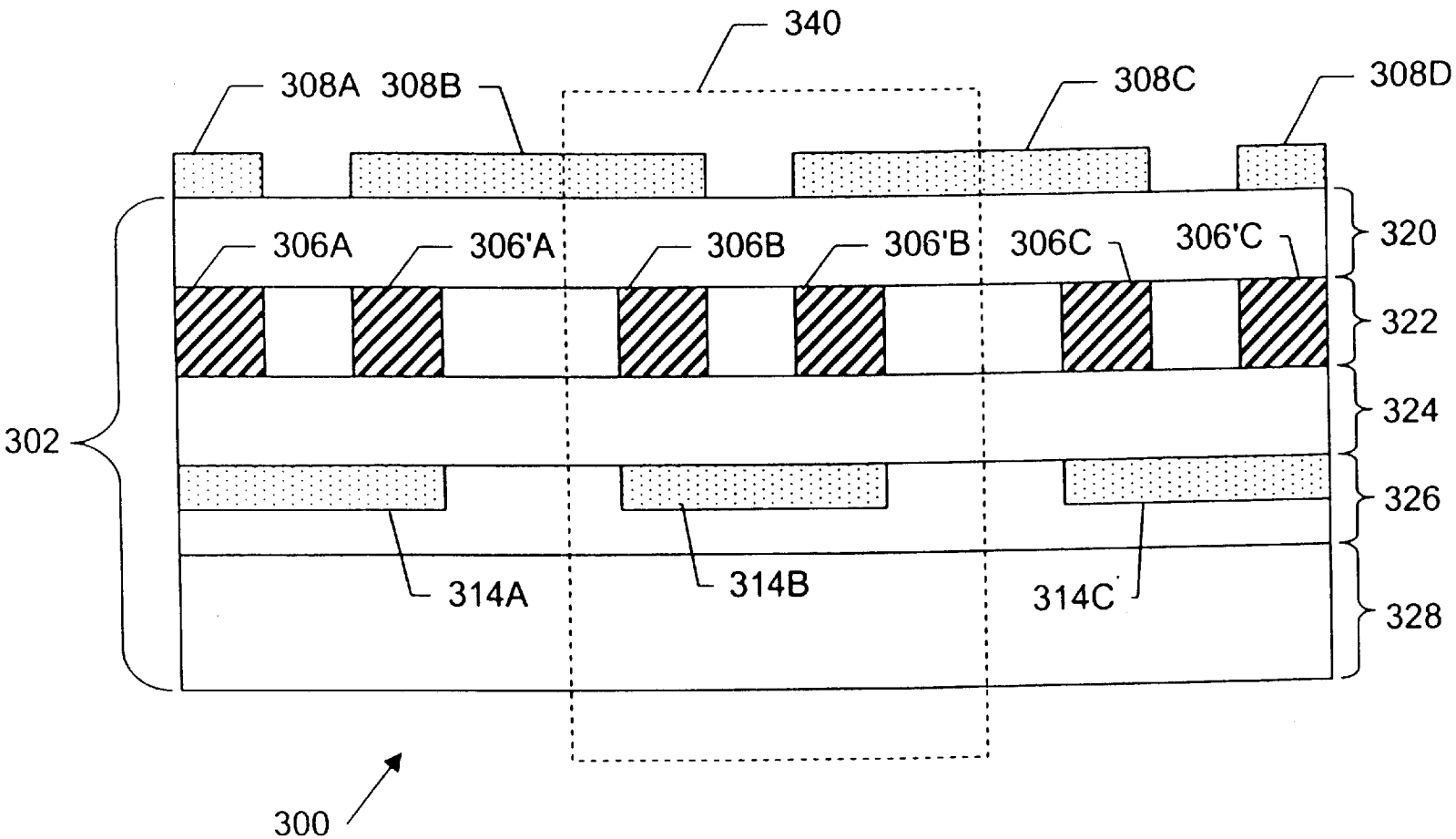
FIG. 3 presents a cross-section of a portion of the sampler array of FIG. 2.

FIG. 3 presents a cross-section of a portion 300 of one embodiment of sampler array 100, which corresponds to section I—I of FIG. 2. Portion 300 includes antenna elements 308A, B, C, D, which are mounted upon body 302. Body 302 includes polymer layers 320, 322, and 324. Each of layers 320, 322 and 324 is approximately 3 micrometers thick, and has a dielectric constant of 3.4 in a preferred embodiment. Within layer 322, optical waveguides are formed and represent the core. Polymer layer 324 adjoins a layer 326 of $SiO_2$ having a thickness of 2.0 micrometers and an epsilon of 3.9 preferably. Layers 320 and 324 effectively become the cladding. Layer 326 adjoins a silicon substrate having a thickness of 10–20 mils, an epsilon of 12, and a rho of 3000 ohm-centimeters. In a preferred embodiment, the electro-optic polymer is a two component material consisting of 15% (by weight) of the chromophore 4-(Dicyanomethylene)-2-methyl-6-(4-dimethylaminostyryl)-4H-pyran (DCM) in the partially-fluorinated polyimide polymer ULTRADEL 4212®, available from BP Amoco Chemicals Inc., Warrensville Heights, Ohio. Although the construction has been described using polymer materials, any suitable electro-optic material may be used to form body 302. Also in a preferred embodiment, antenna elements 308 measure approximately 1 inch on each edge and are separated from each other by a gap measuring between 100 micrometers and 2 mils. Variations on these dimensions may be made to optimize or customize the performance or operation of the present invention.

Layer 322 includes a plurality of optical paths. In particular, the optical paths include paths 306B and 306'B, which form the branches of a single Mach-Zehnder modulator 340. Layer 326 includes a plurality of coupling strips 314. Coupling strip 314B forms a part of Mach-Zehnder modulator 340. In a preferred embodiment, portion 300 is repeated to form an array. Therefore, optical paths 306A, 306'A, 306C and 306'C, as well as antenna elements 308A and 308D and coupling strips 314A and 314C are shown for clarity. These elements form portions of other Mach-Zehnder modulators, as would be apparent to one skilled in the relevant art. Coupling strips 314A and 314C form portions of other Mach-Zehnder modulators.

In operation, the potential induced by electromagnetic energy 114 upon an antenna element 308 with respect to a coupling strip 314 modulates the optical signal on an intervening optical path 306. In particular, the phase of the optical signal changes in accordance with the magnitude of the potential. Referring to Mach-Zehnder modulator 340, when a differential potential exists between antenna element 308B and coupling strip 314B, and when antenna element 308C and metallic strip 314B are tied electrically together, such they are at the same potential, the optical signal traversing optical path 306B is modulated to have a different phase than optical path 306'B. When these optical signals are again joined, an interference pattern results and thus the optical signal becomes amplitude modulated. This amplitude modulated optical signal exits Mach-Zehnder modulator 340 along an output fiber 112.

Figure 4:
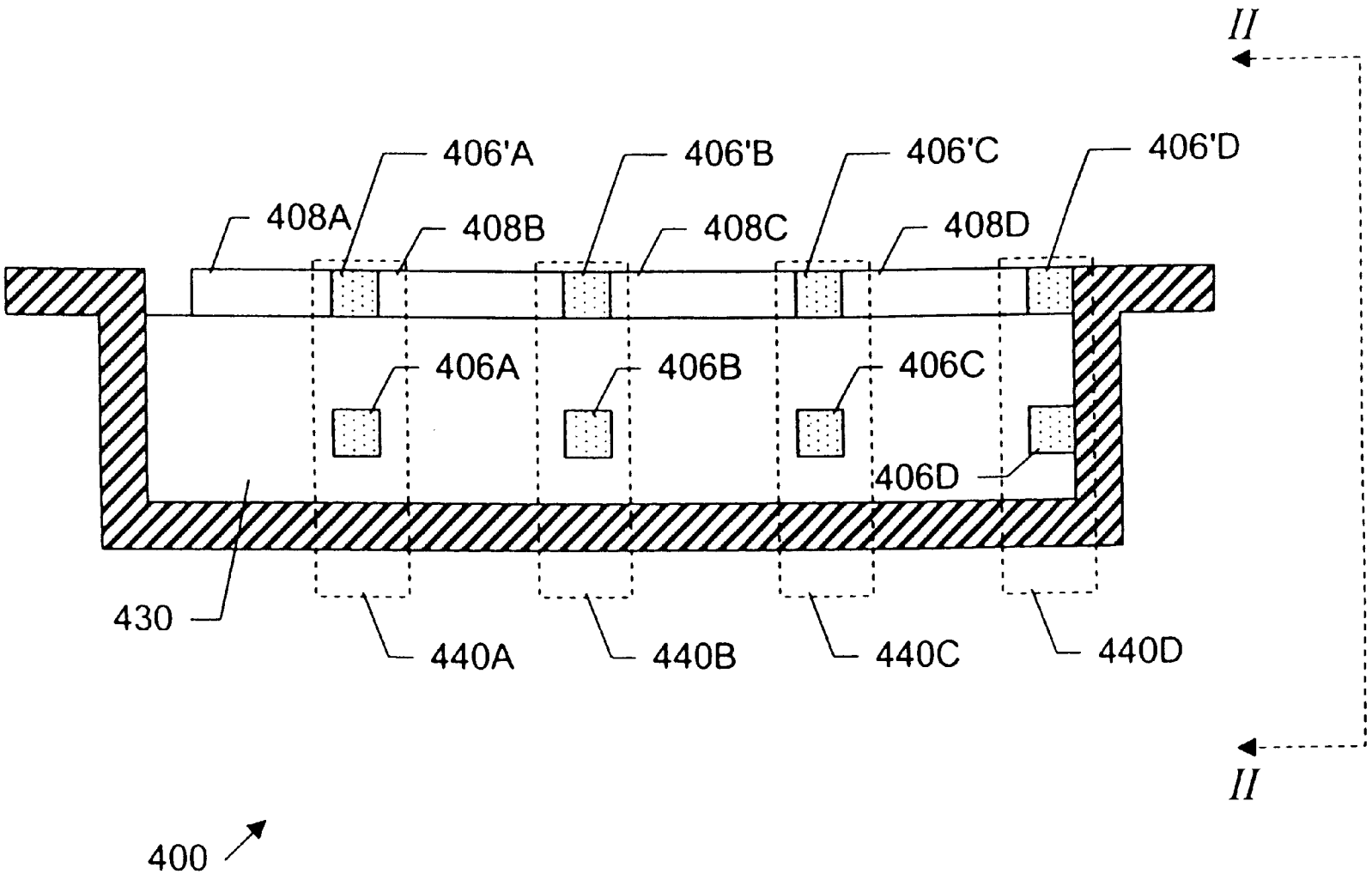
FIG. 4 depicts a portion of a sampler array according to another embodiment of the present invention.

FIG. 4 depicts a portion 400 of a sampler array according to another embodiment of the present invention. In this configuration, Mach-Zehnder modulators 440 have been rotated 90 degrees relative to the surface of the array, as compared to the array of FIG. 1. Portion 400 includes four Mach-Zehnder modulators 440A, B, C, D. Mach-Zehnder modulator 440A is exemplary. Mach-Zehnder modulator 440A includes antenna elements 408A and 408B, optical path 406A, and optical path 406'A. Optical path 406'A is embedded within a material 430. In a preferred embodiment, material 430 is the same polymer material used to form the optical waveguides, and loaded with a chromophore to make it electro-optic. Antenna element 408 is formed by depositing metallic strips onto material 430.

A chromophore is a class of materials that exhibits an "electro-optic" effect. It is through this electro-optic effect that we can manipulate the light that passes the material, as is well known in the relevant arts. For example, an electrical voltage, when applied to an electro-optic material, will alter its optical characteristics, such as its index of refraction. In a preferred embodiment, a chromophore material is embedded in a portion of a polymer layer to create the "core" of an electro-optic waveguide.

Figure 5:
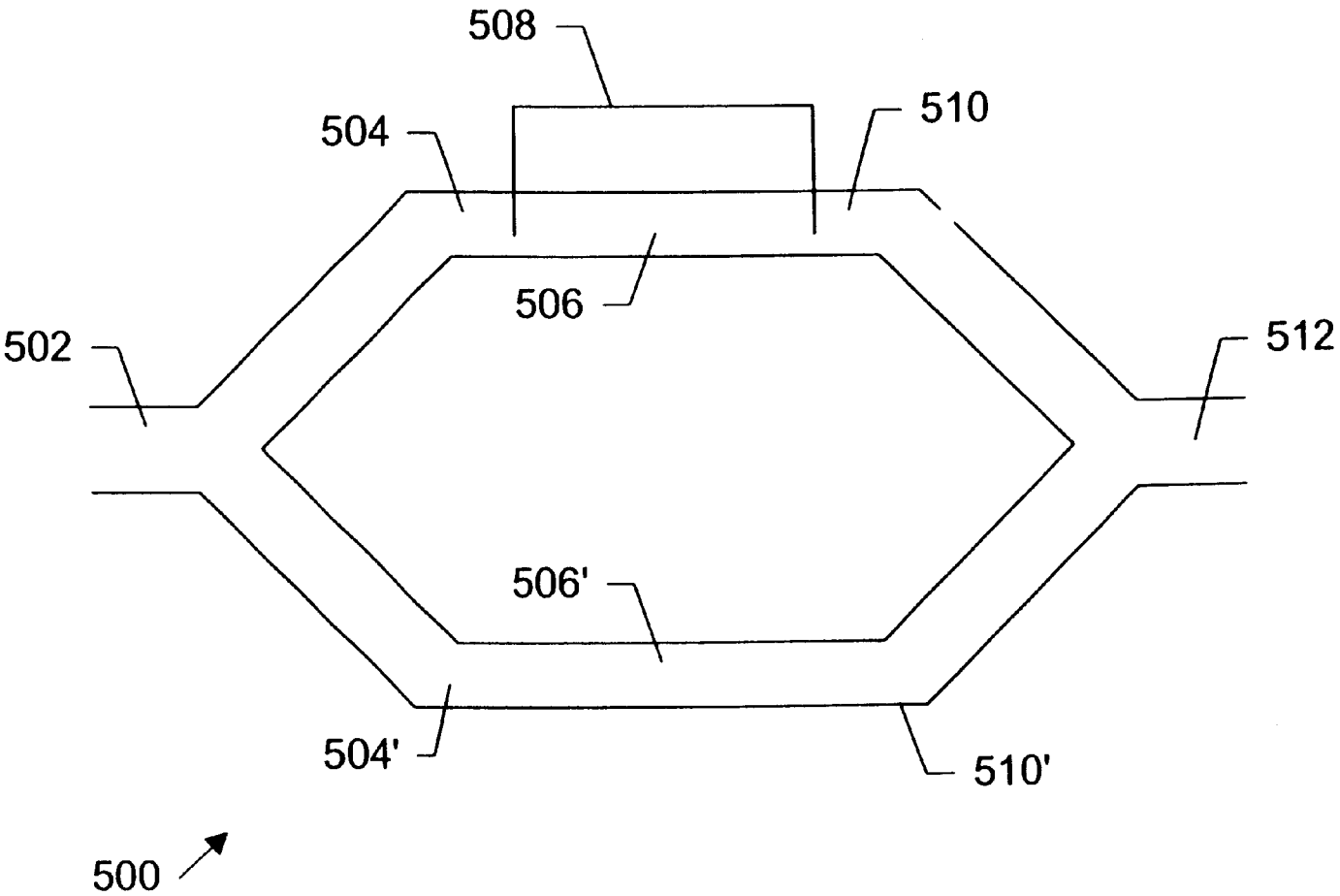
FIG. 5 depicts a cross-section of a portion of the sampler array of FIG. 4.

FIG. 5 depicts a cross-section of a portion 500 of the sampler array of FIG. 4 corresponding to section II—II in FIG. 4. An optical signal enters input optical path 502, and is split into two portions. One portion traverses the "modulated" arm defined by optical paths 504, 506, and 510. The other portion traverses the "unmodulated" arm defined by optical paths 504', 506', and 510'. The optical signal in the modulated arm passes between a pair of antenna elements 508, and so is modulated by the differential potential induced upon the antenna elements by an impinging wavefront. The optical signal traversing the unmodulated arm experiences no differential electrical potential, and so is not modulated. When the modulated and unmodulated signals are joined in output optical path 512, an interference pattern results, producing amplitude modulation of the optical carrier. The resulting signal can be processed as described above.

Figure 6:
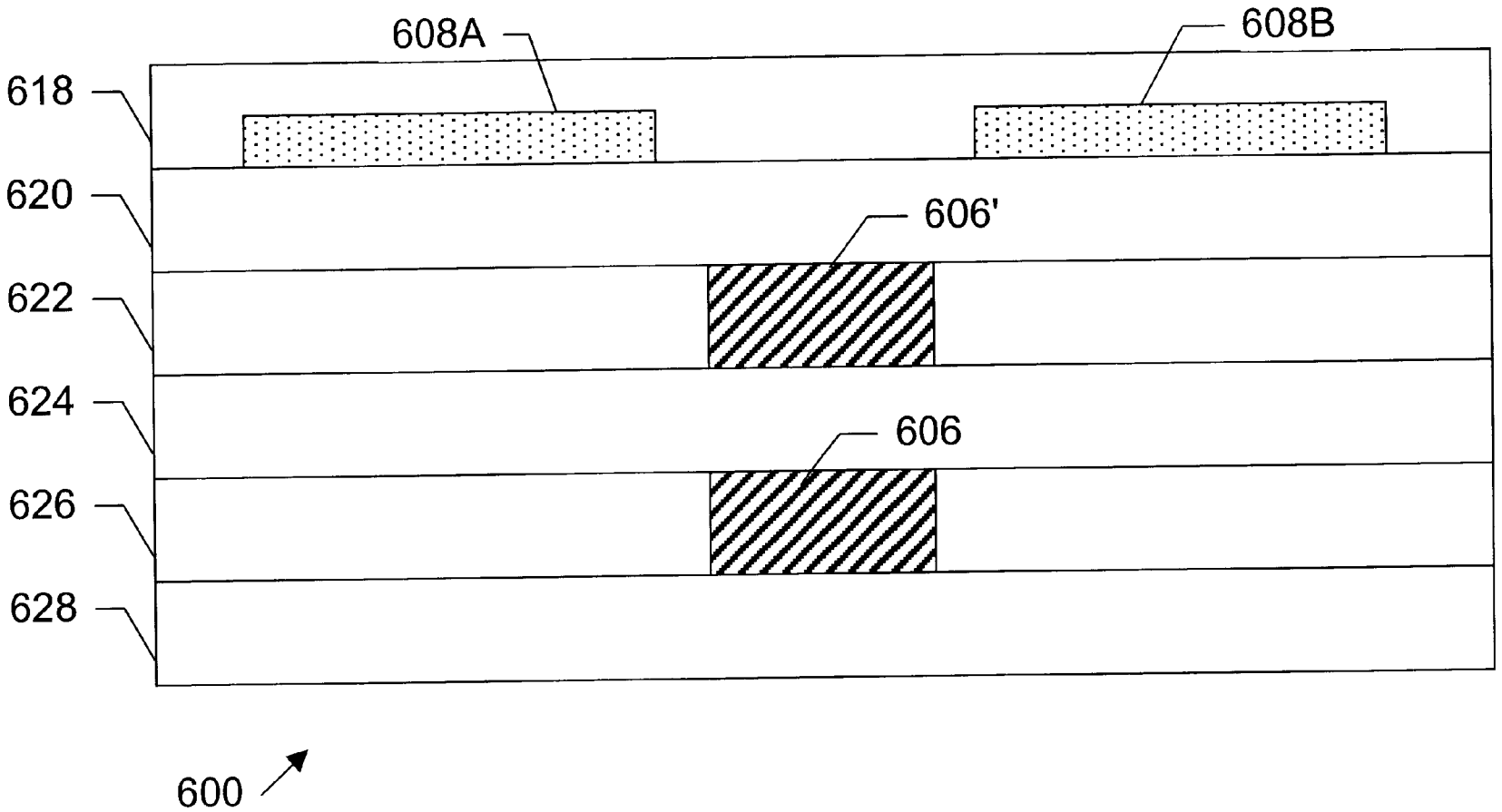
FIG. 6 depicts a portion of a sampler array according to an embodiment of the present invention.

FIG. 6 depicts a portion 600 of a sampler array according to an embodiment of the present invention. In this configuration, as in the configuration of FIG. 4, a Mach-Zehnder modulator has been rotated 90 degrees relative to the surface of the array, as compared to the array of FIG. 1. In this embodiment, there are at least six layers. Starting from the bottom, portion 600 includes a silicon layer 628 that serves as a base onto which the other layers are deposited, a polymer dielectric layer 626, a polymer dielectric layer 624 that is photobleached, and into which an optical waveguide 606 is formed, a polymer layer 622, a polymer layer 620 that is photobleached, and into which an optical waveguide 606' is formed, and onto which metallic strips 608A,B are deposited; and a final polymer layer 618 that covers metallic strips 608 and forms the final waveguide. Other embodiments of the invention are constructed in a similar fashion.

Photobleaching is a method used to change a material's properties through the use of light. Predetermined areas of the material are exposed to light at various wavelengths and strengths to change that material properties, for example, to permanently change the index of refraction. In a preferred embodiment, a "mask" is placed over the material to allow selective photobleaching of predetermined areas of the material. In general, the section of a polymer layer that is to become the "cladding" of a waveguide is photobleached to have a lower index of refraction (for example, n~1.60) than the core (for example, n~1.62). This condition allows light to travel down the waveguide (through the core) without radiating out through the cladding material, as is well known in the relevant arts.

Figure 7:
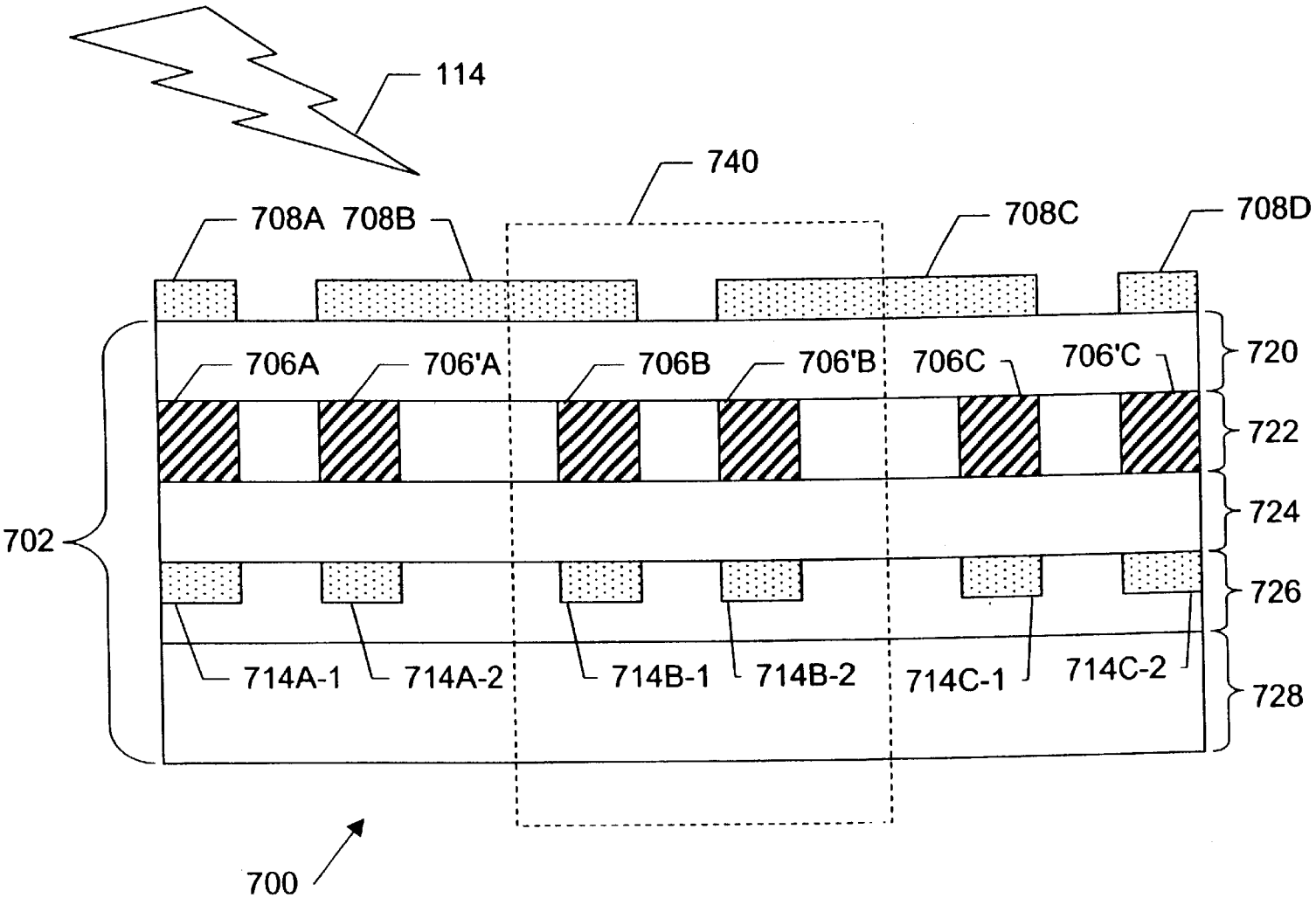
FIG. 7 presents a cross-section of a portion of a sampler array according to another embodiment of the present invention.
Figure 9:
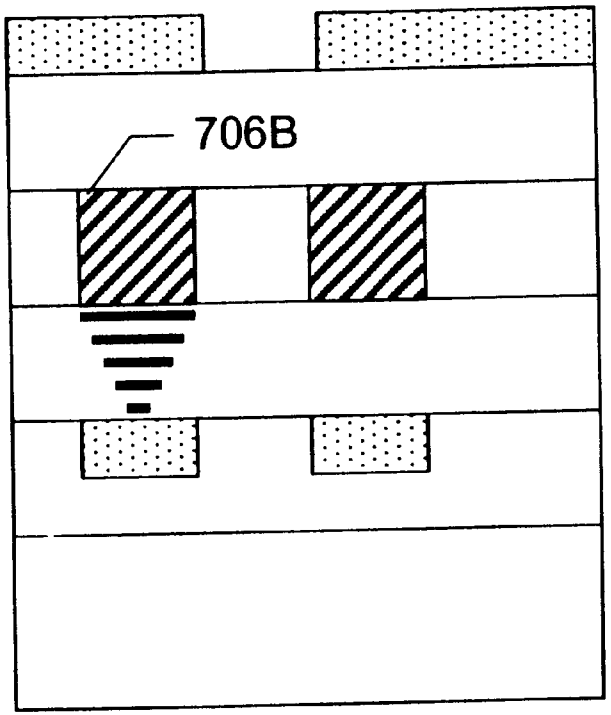
FIG. 9 is a simplified depiction of the operation of the sampler array shown in FIG. 7.

FIG. 7 presents a cross-section of a portion 700 of one embodiment of sampler array 100, which corresponds to section I—I of FIG. 2. Portion 700 is similar to portion 300, shown in FIG. 3. Thus, portion 700 includes antenna elements 708A, B, C, D, which are mounted upon body 702. Body 702 includes polymer layers 720, 722, and 724. Layer 722 includes a plurality of optical paths. In particular, the optical paths include paths 706B and 706'B, which form the branches of a single Mach-Zehnder modulator 740. Layer 726 includes a plurality of coupling strips 714.

In contrast to portion 300, in the embodiment shown in FIG. 7, each coupling strip, such as coupling strip 714B, is divided into two portions, such as coupling strip portions 714B-1 and 714B-2. As shown, the first optical path 706B is disposed between antenna element 708B and the portion 714B-1 of coupling strip 714B, while the second optical path 706'B is disposed between antenna element 708C and the portion 714B-2 of coupling strip 714B. Coupling strip 714B forms a part of Mach-Zehnder modulator 740. In a preferred embodiment, portion 700 is repeated to form an array. Therefore, optical paths 706A, 706'A, 706C and 706'C, as well as antenna elements 708A and 708D and coupling strips 714A and 714C are shown for clarity. These elements form portions of other Mach-Zehnder modulators, as would be apparent to one skilled in the relevant art. Coupling strips 714A and 714C form portions of other Mach-Zehnder modulators.

Figure 8:
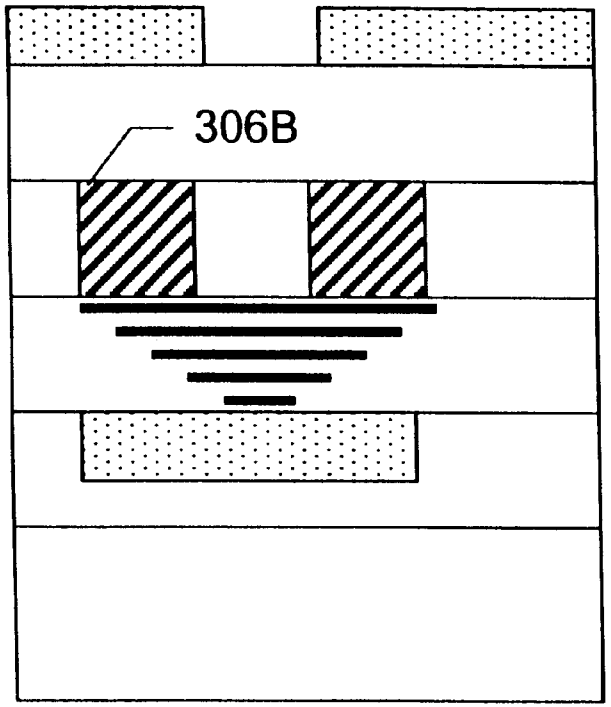
FIG. 8 is a simplified depiction of the operation of the sampler array shown in FIG. 3.

In operation, the potential induced by electromagnetic energy 114 upon an antenna element 708 with respect to a coupling strip 714 modulates the optical signal on an intervening optical path 706. In particular, the phase of the optical signal changes in accordance with the magnitude of the potential. Referring to Mach-Zehnder modulator 740, when a differential potential exists between antenna element 708B and coupling strip 714B, and when antenna element 708C and metallic strip 714B are tied electrically together, such they are at the same potential, the optical signal traversing optical path 706B is modulated to have a different phase than optical path 706'B. When these optical signals are again joined, an interference pattern results and thus the optical signal becomes amplitude modulated. This amplitude modulated optical signal exits Mach-Zehnder modulator 740 along an output fiber 112. The embodiment shown in FIG. 7 increases the interaction voltage across the electro-optically active path by changing the primary direction of the voltage fields. An example of the voltage fields generated in the embodiment of FIG. 3 is shown in FIG. 8. The voltage field 802, which interacts with optical path 306B is spread over a wide area and is thus significantly diffused. By contrast, the voltage field of the embodiment shown in FIG. 7, as shown in FIG. 7, is concentrated in the optical path 706B.

While various embodiments of the present invention have been described above, it should be understood that they have been presented by way of example, and not limitation. It will be apparent to persons skilled in the relevant art that various changes in form and detail can be placed therein without departing from the spirit and scope of the invention. Thus the present invention should not be limited by any of the above-described example embodiments, but should be defined only in accordance with the following claims and their equivalents.

What is claimed is:

1. An antenna comprising:

a first electro-optically active optical waveguide;

a first planar electrode substantially parallel to the first waveguide, the first planar electrode arranged so that an incident electromagnetic signal will impinge upon the first planar electrode;

a second electro-optically active optical waveguide;

a second planar electrode substantially parallel to the second waveguide, the first and second planar electrodes being substantially adjacent and coplanar; and a third planar electrode substantially parallel to the first and second planar electrodes and disposed such that the first waveguide lies between the first and third planar electrodes, and the second waveguide lies between the second and third planar electrodes;

whereby an optical signal in the first waveguide will be modulated by a varying voltage potential induced between the first planar electrode and the third planar electrode by the incident electromagnetic signal.

2. The antenna of claim 1, further comprising:

an optical source coupled to a first end of each of the waveguides.

3. The antenna of claim 2, further comprising:

an output optical waveguide coupled to the second end of each of the first and second waveguides.

4. The antenna of claim 3, further comprising:

a photodetector coupled to the output waveguide.

5. The antenna of claim 4, further comprising:

a coupler electrically connecting the first and third planar electrodes, whereby the first and third planar electrodes are kept at substantially the same electrical potential.

6. The antenna of claim 5, further comprising:

a polymer layer in which the waveguides are formed and to which the planar electrodes are attached.

7. The antenna of claim 1, wherein the third planar electrode comprises a first portion and a second portion and is disposed such that the first waveguide lies between the first planar electrode and the first portion of the third planar electrode, and the second waveguide lies between the second planar electrode and the second portion of the third planar electrode.

8. The antenna of claim 7, further comprising:

an optical source coupled to a first end of each of the waveguides.

9. The antenna of claim 8, further comprising:

an output optical waveguide coupled to the second end of each of the first and second waveguides.

10. The antenna of claim 9, further comprising:

a photodetector coupled to the output waveguide.

11. The antenna of claim 10, further comprising:

a coupler electrically connecting the first planar electrode and the first and second portions of the third planar electrode, whereby the first planar electrode and the first and second portions of the third planar electrode are kept at substantially the same electrical potential.

12. The antenna of claim 11, further comprising:

a polymer layer in which the waveguides are formed and to which the planar electrodes are attached.

13. An antenna comprising:

first and second planar electrodes being substantially adjacent and coplanar, the first planar electrode arranged so that an incident electromagnetic signal will impinge upon the first planar electrode;

a first electro-optically active optical waveguide disposed between the planar electrodes; and a second electro-optically active optical waveguide substantially parallel to the first waveguide;

whereby an optical signal in the first waveguide will be modulated by the incident electromagnetic signal.

14. The antenna of claim 13, further comprising:

an optical source coupled to a first end of each of the waveguides.

15. The antenna of claim 14, further comprising:

an output optical waveguide coupled to the second end of each of the first and second waveguides.

16. The antenna of claim 15, further comprising:

a photo detector coupled to the output waveguide.

17. The antenna of claim 16, further comprising:

a polymer layer in which the waveguides are formed and to which the planar electrodes are attached.

18. The antenna of claim 13, wherein the second planar electrode comprises a first portion and a second portion and the first electro-optically active optical waveguide is disposed between the first planar electrode and the first portion of the second planar electrode.

19. The antenna of claim 18, further comprising:

an optical source coupled to a first end of each of the waveguides.

20. The antenna of claim 19, further comprising:

an output optical waveguide coupled to the second end of each of the first and second waveguides.

21. The antenna of claim 20, further comprising:

a photo detector coupled to the output waveguide.

22. The antenna of claim 21, further comprising:

a polymer layer in which the waveguides are formed and to which the planar electrodes are attached.

23. An antenna comprising:

a plurality of cells, each cell comprising:

a first electro-optically active optical waveguide;

a first planar electrode substantially parallel to the first waveguide, the first planar electrode arranged so that an incident electromagnetic signal will impinge upon the first planar electrode;

a second electro-optically active optical waveguide;

a second planar electrode substantially parallel to the second waveguide, the first and second planar electrodes being substantially adjacent and coplanar; and a third planar electrode substantially parallel to the first and second planar electrodes and disposed such that the first waveguide lies between the first and third planar electrodes, and the second waveguide lies between the second and third planar electrodes;

whereby an optical signal in the first waveguide will be modulated by a varying voltage potential induced between the first planar electrode and the third planar electrode by the incident electromagnetic signal.

24. The antenna of claim 23, further comprising:

an optical source coupled to a first end of each of the waveguides.

25. The antenna of claim 24, further comprising:

an output optical waveguide coupled to the second end of each of the first and second waveguides.

26. The antenna of claim 25, further comprising:

a photodetector coupled to the output waveguide.

27. The antenna of claim 26, further comprising:

a coupler electrically connecting the first and third planar electrodes, whereby the first and third planar electrodes are kept at substantially the same electrical potential.

28. The antenna of claim 27, further comprising:

a polymer layer in which the waveguides are formed and to which the planar electrodes are attached.

29. The antenna of claim 23, wherein the third planar electrode comprises a first portion and a second portion and is disposed such that the first waveguide lies between the first planar electrode and the first portion of the third planar electrode, and the second waveguide lies between the second planar electrode and the second portion of the third planar electrode.

30. The antenna of claim 29, further comprising:

an optical source coupled to a first end of each of the waveguides.

31. The antenna of claim 30, further comprising:

an output optical waveguide coupled to the second end of each of the first and second waveguides.

32. The antenna of claim 31, further comprising:

a photodetector coupled to the output waveguide.

33. The antenna of claim 32, further comprising:

a coupler electrically connecting the first planar electrode and the first and second portions of the third planar electrode, whereby the first planar electrode and the first and second portions of the third planar electrode are kept at substantially the same electrical potential.

34. The antenna of claim 33, further comprising:

a polymer layer in which the waveguides are formed and to which the planar electrodes are attached.

35. An antenna comprising:

a plurality of cells, each cell comprising:

first and second planar electrodes being substantially adjacent and coplanar, the first planar electrode arranged so that an incident electromagnetic signal will impinge upon the first planar electrode;

a first electro-optically active optical waveguide disposed between the planar electrodes; and a second electro-optically active optical waveguide substantially parallel to the first waveguide;

whereby an optical signal in the first waveguide will be modulated by the incident electromagnetic signal.

36. The antenna of claim 35, further comprising:

an optical source coupled to a first end of each of the waveguides.

37. The antenna of claim 36, further comprising:

an output optical waveguide coupled to the second end of each of the first and second waveguides.

38. The antenna of claim 37, further comprising:

a photo detector coupled to the output waveguide.

39. The antenna of claim 38, further comprising:

a polymer layer in which the waveguides are formed and to which the planar electrodes are attached.

40. The antenna of claim 35, wherein the second planar electrode comprises a first portion and a second portion and the first electro-optically active optical waveguide is disposed between the first planar electrode and the first portion of the second planar electrode.

41. The antenna of claim 40, further comprising:

an optical source coupled to a first end of each of the waveguides.

42. The antenna of claim 41, further comprising:

an output optical waveguide coupled to the second end of each of the first and second waveguides.

43. The antenna of claim 42, further comprising:

a photo detector coupled to the output waveguide.

44. The antenna of claim 43, further comprising:

a polymer layer in which the waveguides are formed and to which the planar electrodes are attached.

* * * * *